US006729302B2

(12) United States Patent
Willmann et al.

(10) Patent No.: US 6,729,302 B2
(45) Date of Patent: May 4, 2004

(54) FUEL INJECTION SYSTEM FOR AN INTERNAL-COMBUSTION ENGINE

(75) Inventors: Michael Willmann, Markdorf (DE); Albert Kloos, Friedrichshafen (DE); Gerd Huber, Munich (DE); Paul Neumeir, Neufahrn (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 98 days.

(21) Appl. No.: 10/108,548

(22) Filed: Mar. 29, 2002

(65) Prior Publication Data

US 2002/0179063 A1 Dec. 5, 2002

(30) Foreign Application Priority Data

Apr. 6, 2001 (DE) ..... 101 17 401

(51) Int. Cl.[7] ..... F02M 45/12
(52) U.S. Cl. ..... 123/446; 123/506; 251/31
(58) Field of Search ..... 123/446, 447, 123/506, 467, 458; 251/31

(56) References Cited

U.S. PATENT DOCUMENTS 3,792,390 A * 2/1974 Boyd ..... 335/229
3,943,901 A * 3/1976 Takahashi et al. ..... 123/506
4,247,052 A * 1/1981 Gray ..... 239/585
4,271,807 A * 6/1981 Links et al. ..... 123/506
4,333,436 A * 6/1982 Kopse et al. ..... 123/502
4,450,783 A * 5/1984 Morris et al. ..... 123/458
4,559,511 A * 12/1985 Basnett et al. ..... 335/132
4,928,028 A * 5/1990 Leibovich ..... 335/266
4,979,674 A * 12/1990 Taira et al. ..... 123/467
5,954,030 A * 9/1999 Sturman et al. ..... 123/446
6,163,239 A * 12/2000 Ozawa et al. ..... 335/256
6,494,187 B2 * 12/2002 Giavi et al. ..... 123/490

FOREIGN PATENT DOCUMENTS

| | | |
|---|---|---|
| DE | 19612721 A1 | 10/1996 |
| DE | 19734354 A1 | 2/1999 |
| DE | 19930276 | 1/2000 |
| JP | 11182376 A | 7/1999 |

* cited by examiner

*Primary Examiner*—Thomas N. Moulis
(74) *Attorney, Agent, or Firm*—Crowell & Moring LLP

(57) ABSTRACT

A fuel injection system for an internal-combustion diesel engine has a fuel injector, typically one of several, supplied by way of a high-pressure fuel line with highly pressurized fuel for the injection of the fuel into the combustion space of the internal-combustion engine during an injection operation. A pressure control valve connected in front of the fuel injector in the high-pressure fuel line is provided for controlling the pressure of the fuel injected during the injection operation. The pressure control valve contains a freely displaceable piston operating on both sides and a slide connected into the flow path of the high-pressure fuel line for the opening and closing of the passage cross-section of the flow path of the high-pressure fuel line as a function of the position of the piston. On the forward side of the piston, a first pressure space is provided which acts upon the piston in the opening direction of the slide, and, on the rearward side of the piston, a second pressure space is provided which acts upon the piston in the closing direction of the slide. An adjusting valve is used for adjusting the pressures in the first and/or second pressure space in the sense of a displacement of the piston in the opening or closing position. The fuel injection system according to the invention permits a proportional controlling of the fuel injection pressure during the injection operation over a wide adjusting range.

28 Claims, 1 Drawing Sheet

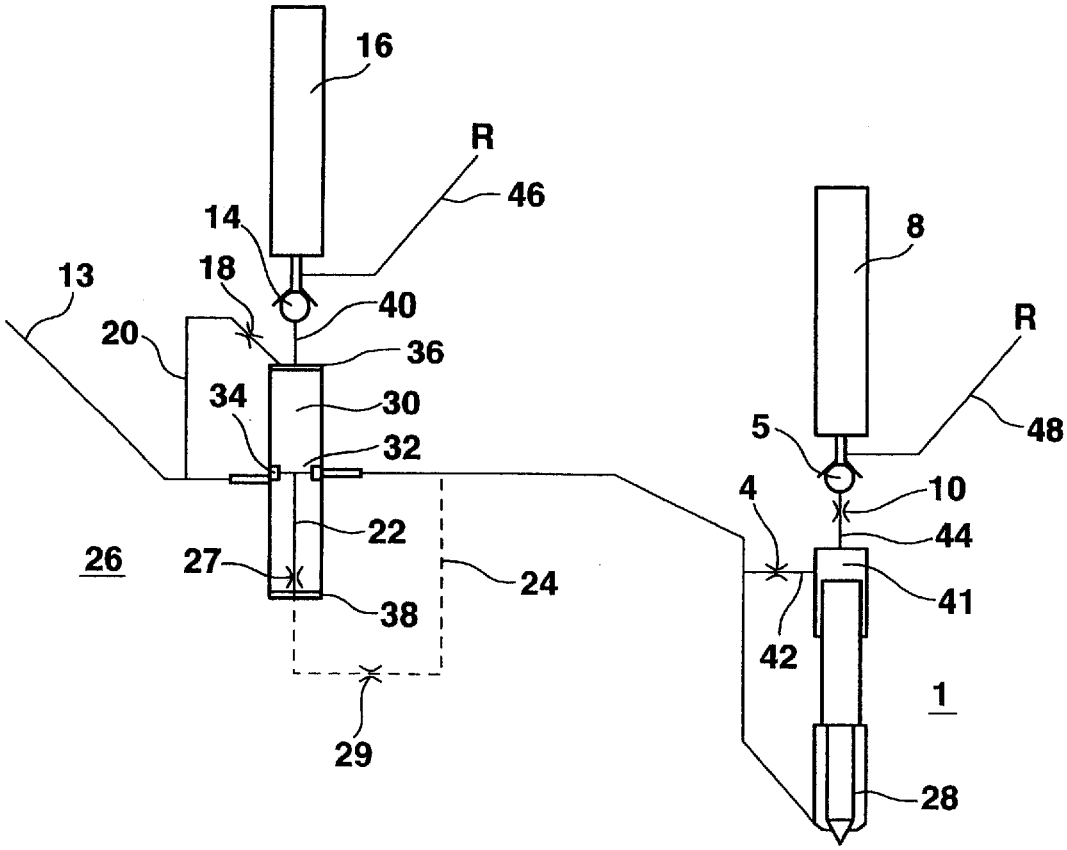
16
R
46
14
18
40
13
20
36
34
30
32
22
26
27
38
24
29
8
R
48
5
10
4
44
41
42
1
28

FUEL INJECTION SYSTEM FOR AN INTERNAL-COMBUSTION ENGINE

BACKGROUND OF THE INVENTION

This application claims the priority of 101 17 401.2, filed in Germany, on Apr. 6, 2001 the disclosure of which is expressly incorporated by reference herein.

The invention relates to a fuel injection system for an internal-combustion engine having a fuel injector which is supplied with highly pressurized fuel by way of a high-pressure fuel line for injecting the fuel into the combustion space of the internal-combustion engine during an injection operation, and having a pressure control valve connected in front of the fuel injector in the high-pressure fuel line for controlling the pressure of the fuel injected during the injection operation.

For internal-combustion engines, particularly for diesel engines, fuel injection systems are known which contain a fuel injector, conventionally one of several, supplied by way of a high-pressure fuel line with highly pressurized fuel for the injection of the fuel into the combustion space of the internal-combustion engine during an injection operation. In addition, in the case of such a fuel injection system, a pressure control valve, which is connected in the high-pressure fuel line in front of the fuel injector, can be provided for controlling the pressure of the fuel injected during the injection operation into the combustion space of the internal-combustion engine.

Thus, from German Patent Document DE 197 34 354 A1, a fuel injection system for an internal-combustion engine of this type is known which has a pressure control valve for the time-dependent modulation of the fuel quantity injected during the injection operation. According to one of the embodiments described there, an adjusting device is provided for controlling this modulation valve, which adjusting device contains a piston acted upon by fuel on both sides. This piston controls a valve needle body of the modulation valve on the basis of a resulting force difference of the pressure forces acting on both sides of the piston. In this case, a first pressure space, which is acted upon by highly pressurized fuel in the opening direction of the modulation valve, is provided on the forward side of the piston acting on both sides, and, on the rearward side of the piston acting on both sides, a second pressure space is provided which is acted upon by fuel in the closing direction. During the displacement of the piston, which acts on both sides, in the sense of an opening of the modulation valve, the second pressure space is relieved from pressure by way of a discharge duct provided with a throttling point.

From German Patent Document DE 199 30 276 A1, an accumulator injection device of a similar type is known, in the case of which, a control valve is provided for the implementation of a second pressure level in the high-pressure fuel line supplying the fuel injector with highly pressurized fuel. When the control valve is closed, the fuel injector is supplied with a residual pressure which is maintained by means of a pressure-maintaining valve provided between the control valve and the fuel injector in the high-pressure fuel line.

It is an object of the invention to provide an improved fuel injection system which permits the shaping of the injection pressure distribution.

According to the invention, this object is achieved according to the invention by providing a fuel injection system for an internal-combustion diesel engine, having a fuel injector which is supplied with highly pressurized fuel by way of a high-pressure fuel line for injecting the fuel into the combustion space of the internal-combustion engine during an injection operation, and having a pressure control valve connected in front of the fuel injector in the high-pressure fuel line for controlling the pressure of the fuel injected during the injection operation, wherein the pressure control valve contains a freely displaceable piston operating on both sides and a slide connected into the flow path of the high-pressure control line for enlarging (opening) and reducing (closing) the passage cross-section of the flow path of the high-pressure fuel line as a function of the position of the piston, a first pressure space on the forward side of the piston which acts upon the piston in the opening direction of the slide, and a second pressure space on the rearward side of the piston which acts upon the piston in the closing direction of the slide, and wherein an adjusting valve is provided for adjusting the pressures in the first and/or second pressure space in the sense of a displacement of the piston in the opening or closing direction.

Advantageous further developments of preferred embodiments of the fuel injection system according to the invention are described herein and in the claims.

The invention provides a fuel injection system for an internal-combustion engine, particularly a diesel engine. The fuel injection system contains a fuel injector supplied by way of a high-pressure fuel line with highly pressurized fuel for the injection of fuel into the combustion space of the internal-combustion engine during an injection operation. Furthermore, a pressure control valve connected in front of the fuel injector in the high-pressure fuel line is provided for controlling the pressure of the fuel injected during the injection operation. According to the invention, the pressure control valve contains a freely displaceable piston, which operates on both sides, and a slide, which is connected into the flow path of the high-pressure fuel line, for the opening and closing of the passage cross-section of the flow path of the high-pressure fuel line as a function of the position of the piston. On the forward side of the piston, a first pressure space is constructed which acts upon the piston in the opening direction of the slide, and, on the rearward side of the piston, a second pressure space is constructed which acts upon the piston in the closing direction of the slide. An adjusting valve is provided for adjusting the pressures in the first and/or the second pressure space in the sense of a displacement of the piston in the opening or closing direction.

According to a preferred embodiment of the fuel injection system according to the invention, the first pressure space provided on the forward side of the piston is connected by way of a first flow connection with the upstream side of the high-pressure fuel line, and the second pressure space provided on the rearward side of the piston is connected by way of a second flow connection with the downstream side of the high-pressure fuel line.

Preferably the adjusting valve is provided for adjusting the pressure of the first pressure space.

According to a preferred embodiment, the adjusting valve is provided in a relief line connected to the first pressure space.

According to a particularly advantageous embodiment of the fuel injection system according to the invention, the adjusting valve comprises a proportional actuating device.

Such a proportional actuating device is particularly advantageously formed by a piezo actuator.

Preferably, an admission throttle is provided in the first flow connection connecting the first pressure space with the upstream side of the high-pressure fuel line.

Furthermore, it is an advantage for a damping throttle to be provided in the second flow connection connected with the downstream side of the high-pressure fuel line.

According to a particularly preferred embodiment of the invention, the second flow connection connecting the second pressure space provided on the rearward side of the piston with the downstream side of the high-pressure fuel line is constructed as a flow duct extending in the piston.

As an alternative, the second flow connection connecting the second pressure space provided on the rearward side of the piston can be connected as an exterior duct with the downstream side of the high-pressure fuel line.

The slide is preferably constructed in one piece with the piston, the first and the second pressure spaces being provided at the ends of the piston, and the slide being provided in a center region of the piston.

In the last-mentioned embodiment, it is particularly advantageous for the flow path of the high-pressure fuel line to form a transverse connection through the center region of the piston.

According to a preferred embodiment of the invention, it is provided that the flow duct forming the second flow connection extends in the longitudinal direction of the piston from the second pressure space to the transverse connection forming the flow path of the high-pressure fuel line.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a schematic block diagram of an embodiment of a fuel injection system according to the invention.

DETAILED DESCRIPTION OF THE DRAWINGS

Reference number 1 indicates a fuel injector for injecting fuel into the combustion space of an internal-combustion engine, particularly a diesel engine, during an injection operation. A highly pressurized fuel is supplied to the fuel injector 1 by way of a high-pressure fuel line 13. The high-pressure fuel line 13 is connected to a high-pressure accumulator which is not shown separately in the FIGURE, which operates in the manner of an oil-elastic high-pressure accumulator and into which the fuel is delivered from a fuel reservoir by means of a high-pressure pump which is also not shown (common-rail system).

The fuel injector 1 may have a conventional construction and comprise an injection nozzle 28 which is opened when a control space 41 is relieved which is provided in the fuel injector 1. Highly pressurized fuel is fed to the control space 41 by the high-pressure fuel line 13 by way of a control pressure line 42 in which an inflow throttle 4 is provided. Furthermore, a relief line 44 is connected with the control space 41, into which relief line 44 a return flow throttle 10 is connected and which can be relieved from pressure by means of a control valve 5 to a leakage line 48, in which case a control quantity R occurs. The control valve 5 can be controlled by way of an actuating device 8, for example, by means of a piezo actuator. When the nozzle 28 of the fuel injector 1 is opened, the fuel supplied by way of the high-pressure fuel line 13 is injected into the combustion space of the internal-combustion engine.

A pressure control valve 26 is provided in the flow path of the high-pressure fuel line 13 and is connected in front of the fuel injector 1. This pressure control valve 26 contains a freely displaceable piston 30 acting on both sides and, constructed in one piece with the latter, a slide 32 for opening and closing the passage cross-section of the flow path of the high pressure line 13 as a function of the position of the piston 30. On the forward side of the piston 30, a first pressure space 36 is provided which acts upon the piston 30 in the opening direction of the slide 32, and, on the rearward side of the piston 30, a second pressure space 38 is constructed which acts upon the piston 30 in the closing direction of the slide 32.

The first pressure space 36 provided on the forward side of the piston 30 is connected by way of a first flow connection 20 with the upstream side of the high-pressure fuel line 13. The second pressure space provided on the rearward side of the piston 30 is connected by way of a second flow connection with the downstream side of the high-pressure fuel line 13, which supplies the fuel to the fuel injector 1.

An adjusting valve 14, 16, which is generally used for adjusting the pressure conditions in the two pressure spaces 36, 38 in the sense of a displacement of the piston 30 in the opening or closing direction, in the embodiment illustrated in the FIGURE, is provided for adjusting the pressure of the first pressure space 36 in a relief line 40 connected to the first pressure space 36. By means of a valve body 14 of the adjusting valve 14, 16, the first pressure space 36 can be relieved from pressure by way of the relief line 40 to a leakage line 46, in which case a control quantity R occurs. The adjusting valve also contains a proportional actuating device 16, which permits a proportional opening and closing of the valve body 14 of the adjusting valve 14, 16 over a defined adjusting range. The proportional actuating device 16 is formed particularly by a piezo actuator.

In the first flow connection connecting the first pressure space 36 with the upstream side of the high-pressure fuel line 13, an inflow throttle 18 is provided by way of which the first pressure space 36 is filled by the high-pressure fuel line 13 with a defined fuel quantity per time unit. From the ratio of the fuel quantity flowing by way of the first flow connection 20 to the first pressure space 36 to the fuel quantity flowing out by way of the relief line 40 and the adjusting valve 14, 16, the pressure in the first pressure space 36 is obtained which acts upon the piston 30 in the opening direction of the slide 32.

In the second flow connection 22, 24, by way of which the second pressure space 38 is connected with the downstream side of the high-pressure fuel line 13, a damping throttle 27 is provided which causes a damping of the fuel quantity flowing in or out from the second pressure space 38 to the downstream side of the high-pressure fuel line 13 during a displacement of the piston.

According to one embodiment, which is illustrated by solid lines in the FIGURE, the second flow connection connecting the second pressure space 38 provided on the rearward side of the piston 30 with the downstream side of the high-pressure fuel line 13 is provided as a flow duct 22 which is constructed to be extending in the piston 30 centrally in its longitudinal direction and leads from the second pressure space 38 to the transverse connection forming the flow path of the high-pressure fuel line 13.

According to an alternative embodiment, which is illustrated by means of broken lines in the FIGURE, this second flow connection is constructed as an exterior duct 24 which leads outside the piston 30 from the second pressure space 38 to the downstream side of the high-pressure fuel line 13.

During the operation of the fuel injection system, the highly pressurized fuel at the high-pressure fuel line 13 is fed as a working fluid to the first pressure space 36 by way of the inflow throttle 18 provided in the first flow connection 20. By means of the valve body of the adjusting valve 14, 16 (2/2-valve) which is controlled by the piezo actuator 16, an arbitrary pressure can be adjusted in the first pressure space 36. This pressure represents the command variable for the proportionally operating pressure control valve 26. The slide 32 connected into the flow path of the high-pressure fuel line 13 takes up a position which is defined by the pressure balance in the first and second pressure spaces 36, 38 at the piston 30 operating on both sides. This results in a displacement of the piston 30 and thus of the slide 32 constructed in one piece with this piston 30 until a pressure equilibrium is established between the first pressure space 36 and the second pressure space 38. If an excess pressure exists in the first pressure space 36 with respect to the second pressure space 38, the piston 30 and, together with the latter, the slide 32 move in the opening direction to the second pressure space 38, the slide 32 opens the flow path of the high-pressure fuel line 13 and thereby again provides a pressure compensation at a higher level. As a result, the pressure, which is determining for the injection operation, on the downstream side of the pressure control valve 36, is simultaneously the regulating variable for the proportional valve 26. In this manner, it is possible to represent almost arbitrary injection courses only by changing the triggering of the pressure control valve 26 by way of the piezo actuator 16.

List of Reference Numbers

| | |
|---|---|
| 1 | Fuel injector |
| 4 | inflow throttle |
| 5 | control valve |
| 8 | actuator |
| 10 | return flow throttle |
| 13 | high-pressure fuel line |
| 14 | adjusting valve |
| 16 | actuator |
| 18 | inflow throttle |
| 20 | first flow connection |
| 22 | second flow connection |
| 24 | second flow connection |
| 26 | pressure control valve |
| 27 | damping throttle |
| 29 | damping throttle |
| 30 | piston |
| 32 | slide |
| 34 | control edges |
| 36 | first pressure space |
| 38 | second pressure space |
| 40 | relief line |
| 41 | control space |
| 42 | control pressure line |
| 44 | relief line |
| 46 | leakage line |
| 48 | leakage line |
| R | control quantity |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Fuel injection system for an internal-combustion diesel engine, having a fuel injector which is supplied with highly pressurized fuel by way of a common rail high-pressure fuel line for injecting the fuel into the combustion space of the internal-combustion engine during an injection operation, and having a pressure control valve connected in the high-pressure fuel line in front of the fuel injector and downstream of a common rail pressure accumulator for controlling the pressure of the fuel injected during the injection operation, wherein the pressure control valve contains a freely displaceable piston operating on both sides and a slide connected into the flow path of the high-pressure control line for opening and closing the passage cross-section of the flow path of the high-pressure fuel line as a function of the position of the piston, a first pressure space on a forward side of the piston which acts upon the piston in the opening direction of the slide, and a second pressure space on a rearward side of the piston which acts upon the piston in the closing direction of the slide, and wherein an adjusting valve is provided for adjusting the pressures in the first and/or second pressure space in the sense of a displacement of the piston in the opening or closing direction.

2. Fuel injection system according to claim 1, wherein the first pressure space provided on the forward side of the piston is connected with the upstream side of the high-pressure fuel line by way of a first flow connection, and wherein the second pressure space provided on the rearward side of the piston is connected with the downstream side of the high-pressure fuel line by way of a second flow connection.

3. Fuel injection system according to claim 1, wherein the adjusting valve is provided for adjusting the pressure of the first pressure space.

4. Fuel injection system according to claim 2, wherein the adjusting valve is provided for adjusting the pressure of the first pressure space.

5. Fuel injection system according to claim 3, wherein the adjusting valve is provided in a relief line connected to the first pressure space.

6. Fuel injection system according to claim 4, wherein the adjusting valve is provided in a relief line connected to the first pressure space.

7. Fuel injection system according to claim 1, wherein the adjusting valve comprises a proportional actuating device.

8. Fuel injection system according to claim 3, wherein the adjusting valve comprises a proportional actuating device.

9. Fuel injection system according to claim 5, wherein the adjusting valve comprises a proportional actuating device.

10. Fuel injection system according to claim 7, wherein the proportional actuating device is a piezo actuator.

11. Fuel injection system according to claim 9, wherein the proportional actuating device is a piezo actuator.

12. Fuel injection system according to claim 2, wherein an inflow throttle is provided in the first flow connection connecting the first pressure space with the upstream side of the high-pressure fuel line.

13. Fuel injection system according to claim 6, wherein an inflow throttle is provided in the first flow connection connecting the first pressure space with the upstream side of the high-pressure fuel line.

14. Fuel injection system according to claim 2, wherein a damping throttle is provided in the second flow connection which is connected with the downstream side of the high-pressure fuel line.

15. Fuel injection system according to claim 6, wherein a damping throttle is provided in the second flow connection which is connected with the downstream side of the high-pressure fuel line.

16. Fuel injection system according to claim 15, wherein an inflow throttle is provided in the first flow connection connecting the first pressure space with the upstream side of the high-pressure fuel line.

17. Fuel injection system according to claim 2, wherein the second flow connection connecting the second pressure space provided on the rearward side of the piston with the downstream side of the high-pressure fuel line is constructed as a flow duct extending in the piston.

18. Fuel injection system according to claim 6, wherein the second flow connection connecting the second pressure space provided on the rearward side of the piston with the downstream side of the high-pressure fuel line is constructed as a flow duct extending in the piston.

19. Fuel injection system according to claim 2, wherein the second flow connection connecting the second pressure space provided on the rearward side of the piston with the downstream side of the high-pressure fuel line is constructed as an exterior duct.

20. Fuel injection system according to claim 6, wherein the second flow connection connecting the second pressure space provided on the rearward side of the piston with the downstream side of the high-pressure fuel line is constructed as an exterior duct.

21. Fuel injection system according to claim 1, wherein the slide is constructed in one piece with the piston, the first and second pressure spaces being provided at the ends of the piston, and the slide being provided in a center region of the piston.

22. Fuel injection system according to claim 21, wherein the flow path of the high-pressure fuel line forms a transverse connection through the center region of the piston.

23. Fuel injection system according to claim 9, wherein the flow path of the high-pressure fuel line forms a transverse connection through the center region of the piston; and wherein the flow duct forming the second flow connection extends in the longitudinal direction of the piston from the second pressure space to the transverse connection forming the flow path of the high-pressure fuel line.

24. A pressure control valve assembly disposable in a common rail high pressure fuel line to control pressure of fuel injected into a combustion chamber from the high pressure fuel line, said control valve comprising:

a freely displaceable piston for controlling movement of a slide which is operable to control a flow cross-section in said high pressure line, first and second pressure spaces containing fluid acting on respective opposite ends of said piston, and an adjusting valve operable to adjust pressure in at least one of said first and second pressure spaces to thereby adjustably displace the piston and slide in respective high pressure line flow cross-section opening and closing directions.

25. A pressure control valve assembly according to claim 24, wherein the first pressure space provided on the forward side of the piston is connected with the upstream side of the high-pressure fuel line by way of a first flow connection, and wherein the second pressure space provided on the rearward side of the piston is connected with the downstream side of the high-pressure fuel line by way of a second flow connection.

26. A pressure control valve assembly according to claim 25, wherein the adjusting valve comprises a proportional actuating device.

27. A pressure control valve assembly according to claim 26, wherein an inflow throttle is provided in the first flow connection connecting the first pressure space with the upstream side of the high-pressure fuel line.

28. A pressure control valve assembly according to claim 27, wherein a damping throttle is provided in the second flow connection which is connected with the downstream side of the high-pressure fuel line.

* * * * *